US007618020B2

(12) United States Patent
Del Favero

(10) Patent No.: US 7,618,020 B2
(45) Date of Patent: Nov. 17, 2009

(54) ADJUSTABLE FULCRUM MEMBER FOR USE WITH A PRY BAR

(76) Inventor: Michael L. Del Favero, 1159 Shelter, Lansing, MI (US) 48912

( * ) Notice: Subject to any disclaimer, the term of this patent is extended or adjusted under 35 U.S.C. 154(b) by 578 days.

(21) Appl. No.: 10/996,244

(22) Filed: Nov. 23, 2004

(65) Prior Publication Data

US 2006/0108570 A1 May 25, 2006

(51) Int. Cl.
*B25C 11/00* (2006.01)

(52) U.S. Cl. ..... 254/25; 254/21; 254/131

(58) Field of Classification Search ..... 254/25, 254/131, 17, 28, 130, 26 E, 27, 1, 21
See application file for complete search history.

(56) References Cited

U.S. PATENT DOCUMENTS

| | | | | | |
|---|---|---|---|---|---|
| 119,770 | A | | 10/1871 | Ives | |
| 206,516 | A | * | 7/1878 | Adgate | 254/130 |
| 541,531 | A | * | 6/1895 | Graves et al. | 254/27 |
| 584,189 | A | | 6/1897 | Nelson | |
| 838,987 | A | | 12/1906 | Hanking | |
| 949,337 | A | | 2/1910 | Trogner | |
| 1,164,155 | A | * | 12/1915 | Woodson | 254/130 |
| 2,569,242 | A | | 9/1951 | Kors | |
| 2,907,106 | A | | 10/1959 | Lockwood | |
| 3,029,502 | A | | 4/1962 | Middaugh | |
| 3,744,758 | A | | 7/1973 | Nakasone | |
| 4,042,210 | A | | 8/1977 | Feldmann | |
| 5,749,113 | A | * | 5/1998 | Witter | 254/131 |
| 2006/0108570 | A1 | * | 5/2006 | Del Favero | 254/131 |

* cited by examiner

*Primary Examiner*—Lee D Wilson
(74) *Attorney, Agent, or Firm*—Ian C. McLeod

(57) ABSTRACT

An adjustable fulcrum for use with a pry bar to provide the pry bar with leverage to lift or move an object. A tool for lifting or moving an object including a pry bar with a fulcrum member. The fulcrum member has a body with slots in the sidewall of the body. The slots extend part of the length of the body of the fulcrum member between the ends of the body parallel to the longitudinal axis of the fulcrum member. One (1) end of the slots is open to allow for easily mounting the fulcrum member on the pry bar. The fulcrum member is mounted on the pry bar so that the pry bar extends through two (2) of the slots of the fulcrum member.

12 Claims, 3 Drawing Sheets

ADJUSTABLE FULCRUM MEMBER FOR USE WITH A PRY BAR

CROSS-REFERENCE TO RELATED APPLICATION

Not Applicable

STATEMENT REGARDING FEDERALLY SPONSORED RESEARCH OR DEVELOPMENT

Not Applicable

BACKGROUND OF THE INVENTION (1) Field of the Invention

The present invention relates to an adjustable fulcrum member for use with a pry bar. Further, the present invention relates to a lifting tool for lifting an object which includes a pry bar and a fulcrum member slidably adjustable along the length of the pry bar.

(2) Description of the Related Art

The related art shows various tools used for lifting or prying which have a fulcrum which is adjustable along the length of the bar. Illustrative are U.S. Pat. No. 4,042,210 to Feldmann; U.S. Pat. No. 3,744,758 to Nakasone and U.S. Pat. No. 3,029,502 to Middaugh.

Feldmann describes a pry tool having a fulcrum member adjustably mounted on the pry tool. The pry portion of the pry tool is slidably mounted in a slot in the fulcrum member. A clamp is provided on the fulcrum member to secure the fulcrum member to the pry portion of the tool. The fulcrum member has a substantially elliptical transverse cross-section.

Nakasone describes a fulcrum slidable along the length of a crowbar stem. The fulcrum has a ring shape with a center opening. The fulcrum has a side opening to enable the fulcrum to be slipped onto the crowbar stem.

Middaugh describes a tool for removing hub caps. The tool has a resilient fulcrum member slidably mounted on the bar. The fulcrum member has a spherical shape with an aperture extending through the center.

Also of interest is U.S. Pat. No. 2,907,106 to Lockwood which describes a hand tool for removing floor coverings. The tool has an elongated body with a fulcrum fixably mounted at one end. A blade is mounted on the fulcrum. The fulcrum has an aperture disposed on a chord of the circle so that a major portion of the fulcrum is disposed below the forward end of the body.

Also, of some interest are U.S. Pat. No. 119,770 to Ives; U.S. Pat. No. 584,189 to Nelson; U.S. Pat. No. 838,987 to Hanking and U.S. Pat. No. 949,337 to Trogner which all show staple or spike pullers having adjustable fulcrums which are slidable along the length of the puller.

Only of minimal interest is U.S. Pat. No. 2,569,242 to Kors which shows a tire lifter having a fulcrum which is fixably adjustable along a lowermost face of the bar.

There remains a need for a fulcrum member which can be adjustably and removably mounted on a pry bar and which has multiple open ended slots for enabling easy mounting of the fulcrum member on the pry bar and to allow for adjusting the leverage provided by the handle end of the pry bar.

Further, there remains a need for a lifting tool for lifting an object which includes a pry bar with an adjustable fulcrum member where the fulcrum member is movable along the pry bar to adjust the leverage provided by the pry bar and has multiple slots to allow for further adjustment of the leverage provided by the pry bar.

SUMMARY OF THE INVENTION

An adjustable fulcrum for use with a pry bar to provide the pry bar with leverage to lift or move an object. A tool for lifting or moving an object including a pry bar with a fulcrum member. The fulcrum member has a body with slots in the sidewall of the body. The slots extend part of the length of the body of the fulcrum member between the ends of the body parallel: to the longitudinal axis of the fulcrum member. One (1) end of the slots is open to allow for ease in mounting the fulcrum member on the pry bar. In one (1) embodiment, the body of the fulcrum member is cylindrical and than three (3) slots. The sidewall of the body of the fulcrum member is curved so that the fulcrum member can easily rotate or pivot on the ground surface.

The tool is used similar to a standard pry bar. The first end of the pry bar is positioned under the object to be moved. Next, the fulcrum member is mounted on the pry bar so that the pry bar extends through two (2) slots of the fulcrum member. The handle end of the pry bar is raised up away from the ground surface and the fulcrum member is moved toward the first end of the pry bar until the fulcrum member is sandwiched between the pry bar and the ground surface and the pry bar is at the correct angle to the ground surface as necessary to provide the correct amount of leverage needed to lift the object. The leverage provided by the pry bar can be adjusted by moving the fulcrum member along the length of the pry bar between the ends of the pry bar. The leverage provided by the pry bar can also be changed by changing the slots used to mount the fulcrum member on the pry bar. Choosing slots which are spaced further apart about the circumference of the sidewall of the body of the fulcrum member increases the amount of the body of the fulcrum member located between the bottom surface of the pry bar and the ground surface which increases the angle of the pry bar with respect to the ground surface and increases the leverage provided by the handle. Once the fulcrum member is correctly positioned, a downward force is applied to the handle end of the pry bar which causes the fulcrum member to rotate and allows the pry bar to pivot about the fulcrum member lifting the first end of the pry abr away from the ground surface and thus, lifting the object.

The tool can also be used to move an object. A slide pad on the outer surface of the sidewall of the body of the fulcrum member between the two (2) of the slots is constructed of a low friction material and has a smooth outer surface. When a force is applied to the pry bar to lift the object, the slide pad contacts the ground surface. When a moving force is applied to the handle end of the pry bar, the fulcrum member slides along the ground surface on the slide pad and the force is transferred to the lifted object to move the object in the direction of the moving force.

The present invention relates to a tool for lifting an object which comprises: a pry bar having a first end and an opposed second end forming a longitudinal axis of the pry bar; and an adjustable and removable fulcrum member having a first end and a second end forming a longitudinal axis of the fulcrum member with a sidewall extending along the longitudinal axis between the ends, the fulcrum member having at least three, spaced apart slots extending parallel to the longitudinal axis of the fulcrum member, each slot having an open end adjacent the first end of the fulcrum member, wherein the fulcrum member is configured to be slidably mounted on the pry bar between the first and second ends of the pry bar so that the pry bar extends between two of the slots through the fulcrum member.

Further, the present invention relates to a tool for lifting an object which comprises: a pry bar having a first end and a second end forming a longitudinal axis of the pry bar; and a fulcrum member configured to be slidably and removably mounted on the pry bar between the ends of the pry bar, the fulcrum member having a first end and a second end forming a longitudinal axis of the fulcrum member with a sidewall extending between the ends and having at least three spaced apart slots extending parallel to the longitudinal axis of the fulcrum member, each of the slots having an open, first end adjacent the first end of the fulcrum member, wherein at least a portion of the sidewall of the fulcrum member adjacent the slots is curved and wherein the fulcrum member is mounted on the pry bar so that the pry bar extends between two of the slots of the fulcrum member with the first end of the pry bar extending beyond one of the slots of the fulcrum member in a first direction and the second end of the pry bar extending beyond one of the other slots of the fulcrum member in a second direction opposite the first direction.

Still further, the present invention relates to a fulcrum member for use on a pry bar for lifting an object away from a surface, the pry bar having a first end and a second end, the fulcrum member which comprises: a body having a first end and a second end forming a longitudinal axis of the fulcrum member with a sidewall extending therebetween; a first slot through the sidewall of the body extending parallel to the longitudinal axis of the fulcrum member; a second slot through the sidewall of the body extending parallel to the longitudinal axis of the fulcrum member, wherein the second slot is spaced apart from the first slot so that when the fulcrum member is positioned on the pry bar in a first position, the pry bar extends through the first slot, through the body and through the second slot; and a third slot through the sidewall of the body extending parallel to the longitudinal axis of the body wherein the third slot is spaced apart from the first slot so that when the fulcrum member is positioned on the pry bar in a second position, the pry bar extends through the first slot, through the body and through the third slot.

Further still, the present invention relates to a method for lifting an object in a first direction away from a surface which comprises the steps of: providing a pry bar having a first end and an opposed second end forming a longitudinal axis of the pry bar; an adjustable and removable fulcrum member having a first end and a second end forming a longitudinal axis of the fulcrum member with a sidewall extending along the axis between the ends, the fulcrum member having at least three, spaced apart slots extending parallel to the axis of the fulcrum member, each slot having an open end adjacent the first end of the fulcrum member; positioning the fulcrum member on the pry bar so that the pry bar extends through two of the slots of the fulcrum member; positioning the first end of the pry bar between the object and the surface; moving the fulcrum member along the pry bar; and applying a lifting force on the second end of the pry bar in a second direction opposite the first direction wherein the pry bar pivots at the fulcrum member and lifts the object to a raised position in the first direction.

The substance and advantages of the present invention will become increasingly apparent by reference to the following drawings and the description.

BRIEF DESCRIPTION OF THE PREFERRED EMBODIMENTS

Figure 2:
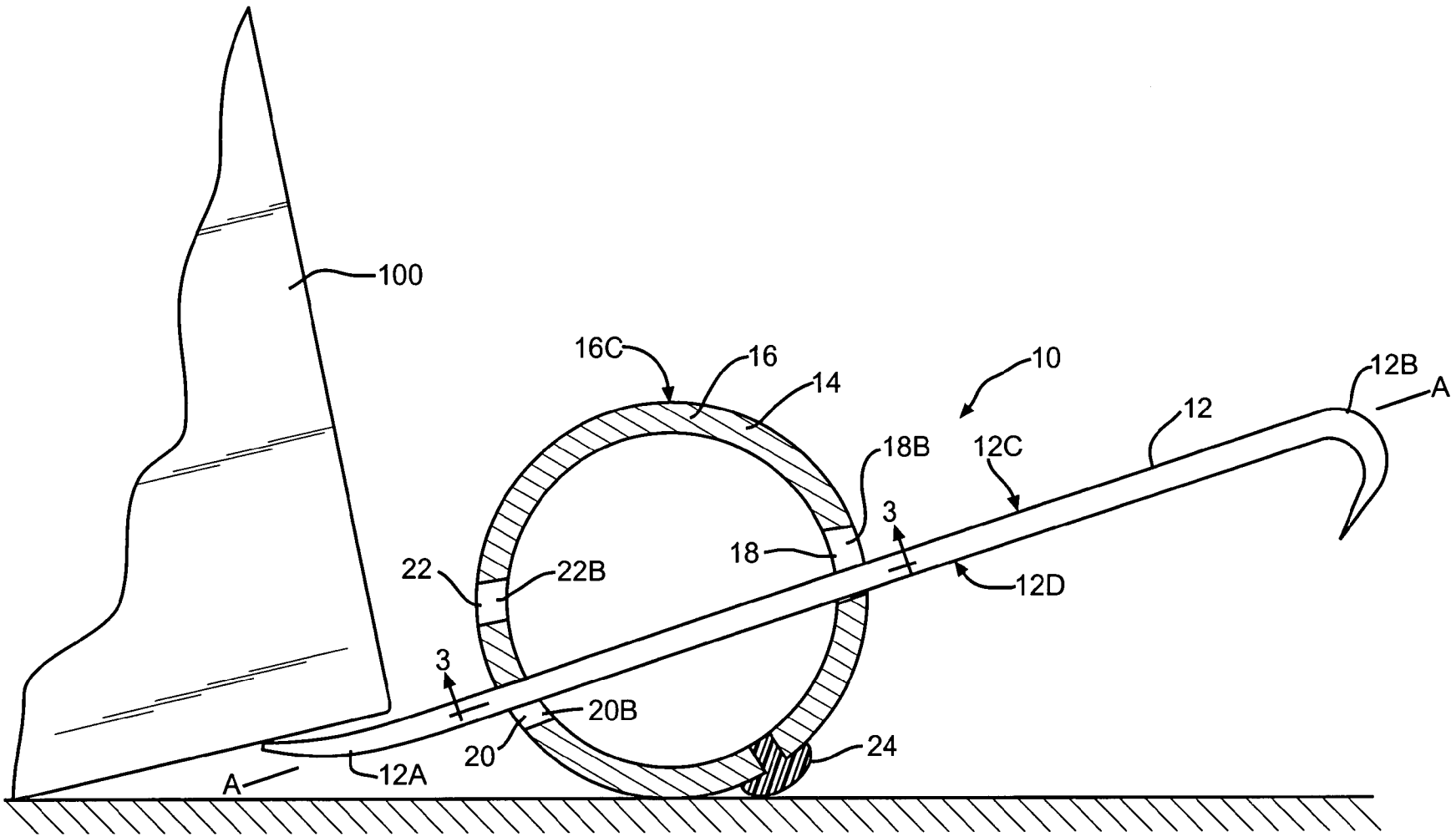
FIG. 2 is a side view showing the pry bar 12 lifting an object 100 off a ground surface with the fulcrum member 14 in cross-section.

The lifting or prying tool 10 of the present invention includes a pry bar or flat bar 12 having a fulcrum member 14. The pry bar 12 has a first lifting end 12A and a second handle end 12B forming the longitudinal axis A-A of the pry bar 12 with a top surface 12C and a bottom surface 12D and sides extending along a length of the pry bar 12 between the ends 12A and 12B (FIG. 2). The first end 12A of the pry bar 12 has a wedge like shape to enable the first end 12A of the pry bar 12 to be positioned under the object 100 to be lifted. In one (1) embodiment, the second end 12B of the pry bar 12 has a hook like shape with a V-shaped notch in the end. In this embodiment, the second end 12B of the pry bar 12 can be used to remove nails or staples. In one (1) embodiment, the pry bar 12 has a rectangular shape and has an essentially flat cross-section. In another embodiment, the pry bar 12 has an essentially circular cross-section. The pry bar 12 is similar to standard pry bars or flat bars well known to one skilled in the art.

Figure 1:
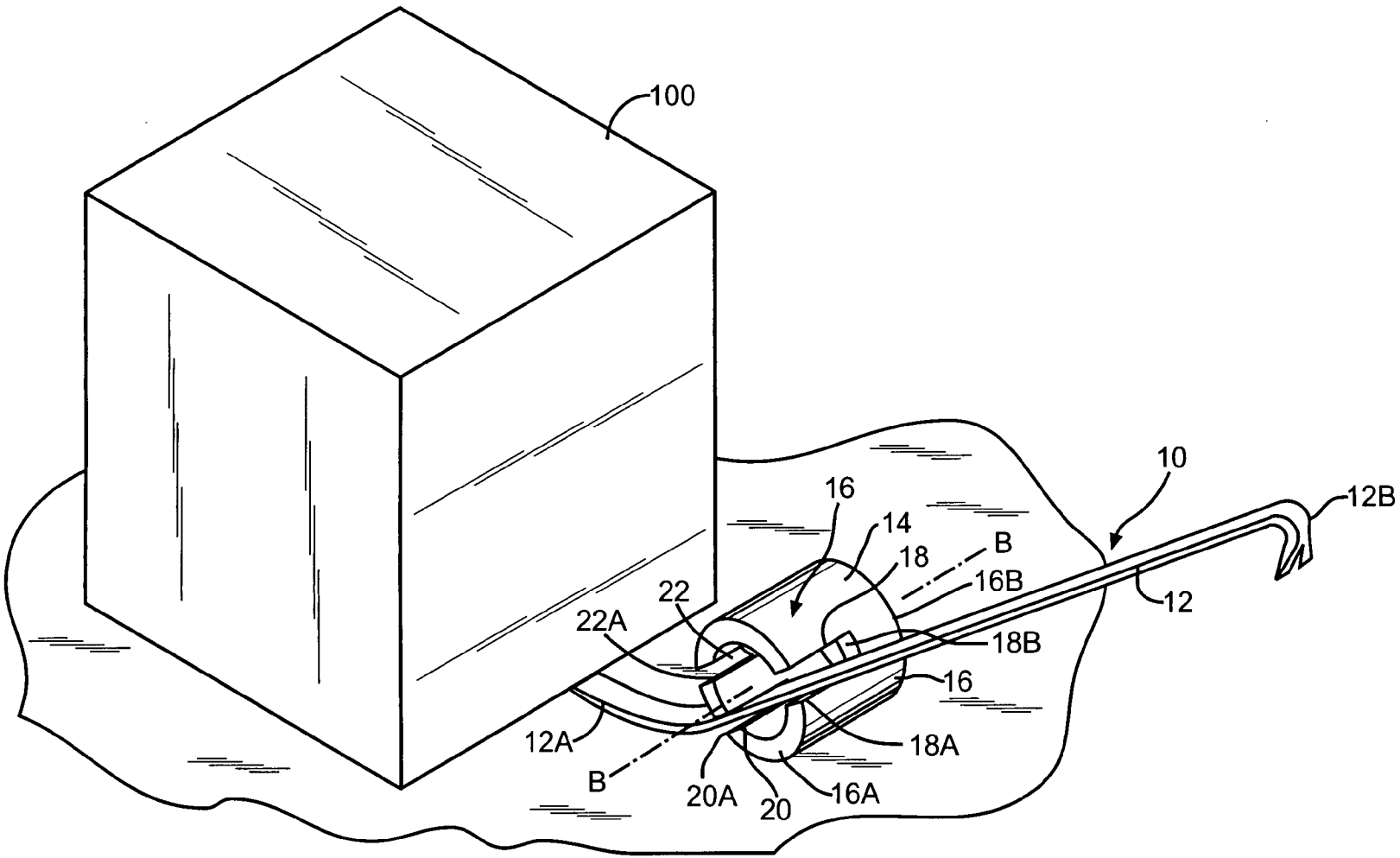
FIG. 1 shows the pry bar 12 having an adjustable fulcrum member 14 being used to lift an object 100.

The fulcrum member 14 has a body 16 with a first end 16A and a second end 16B forming the longitudinal axis B-B of the fulcrum member 14 and having a sidewall 16C extending along a length of the body 16 between the ends 16A and 16B (FIG. 1). In one (1) embodiment, the body 16 of the fulcrum member 14 has an essentially cylindrical shape with a circular cross-section and a curved sidewall 16C. In one (1) embodiment, the body 16 of the fulcrum member 14 is hollow and the sidewall 16C surrounds a center bore. In one (1) embodiment, the body 16 of the fulcrum member 14 has a length between the ends 16A and 16B of about 2.5 inches (63.5 mm) and has a diameter of about 2.875 inches (73.02 mm). In one (1) embodiment, the length of the body 16 of the fulcrum member 14 between the ends 16A and 16B is at least equal to a width of the pry bar 12 between the sides adjacent the second end 12B of the pry bar 12.

Figure 3:
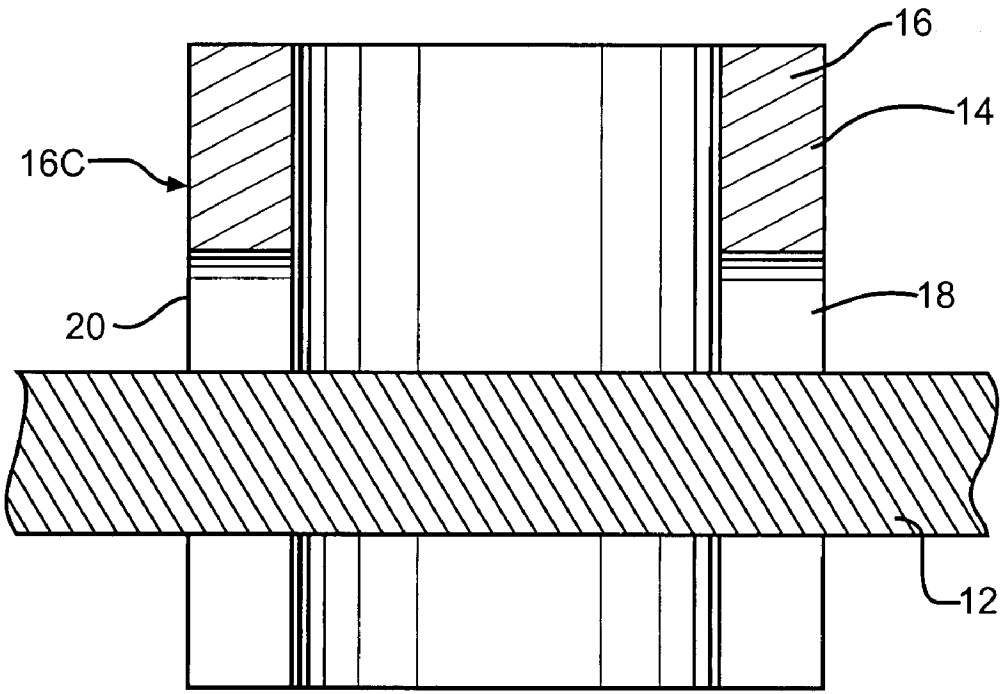
FIG. 3 is a partial view of line 3-3 of FIG. 2 showing the pry bar 12 positioned in the slots 18 and 20 of the fulcrum member 14.

The body 16 of the fulcrum member 14 is provided with slots 18, 20 and 22 spaced apart around a circumference of the sidewall 16C of the body 16. The slots 18, 20 and 22 have opposed ends 18A, 18B, 20A, 20B and 22A and 22B defining a length of the slots 18, 20 and 22 with sides extending between the ends 18A, 18B, 20A, 20B, 22A and 22B defining a width of the slots 18, 20 and 22. The open first end 18A, 20A and 22A of the slots 18, 20 and 22 is adjacent the first end 16A of the body 16 of the fulcrum member 14. The slots 18, 20 and 22 extend from the open end 18A, 20A and 22A toward the second ends 18B, 20B and 22B of the slots 18, 20 and 22 and toward the second end 16B of the body 16 parallel to the longitudinal axis B-B of the fulcrum member 14. In one (1) embodiment, all the slots 18, 20 and 22 have a similar shape, width and length. In one (1) embodiment, the first slot 18 has a width between the sides greater than the width of the second and third slots 20 and 22. The greater width of the first slot 18 allows for moving and angling the pry bar 12 in the first slot 18 so that the pry bar 12 can be moved between the second and third slots 20 and 22 as necessary to adjust the leverage. It is understood that the size and shape of the slots 18, 20 and 22 can be adjusted depending on the size and shape of the pry bar 12 on which the fulcrum member 14 is to be mounted. In one (1) embodiment, the first slot 18 has a width between the sides of 0.5 inches (12.7 mm) and the second and third slots 20 and 22 have a width between the sides of 0.325 inches (7.94 mm). In one (1) embodiment, the width of the slots 18, 20 and 22 is such as to enable a variety of pry bars 12 having a variety of thicknesses between the top and bottom surface 12C and 12D to be used with the fulcrum member 14. In one (1) embodiment, the slots 18, 20 and 22 have a length between the ends 18A, 20A and 22A, 18B, 20B and 22B greater than a width of the pry bar 12 between the sides of the pry bar 12 so that the pry bar 12 can be positioned completely within the slots 18, 20 and 22 spaced between the ends 18A, 20A and 22A, 18B, 20B and 22B of the slots 18, 20 and 22 (FIG. 3). In one (1) embodiment, the slots 18, 20 and 22 are positioned in approximately one-half of the circumference of the sidewall 16C of the body 16. In one (1) embodiment, the fulcrum member 14 has a first slot 18, a second slot 20 and a third slot 22. In one (1) embodiment, the second and third slots 20 and 22 are spaced apart 0.5 inches (12.7 mm) about the sidewall 16C of the body 16 of the fulcrum member 14. In one (1) embodiment, the first slot 18 is spaced apart approximately 170° from the second slot 20 in a clockwise direction in the sidewall 16C of the body 16 of the fulcrum member 14. In one (1) embodiment, the first slot 18 is spaced apart approximately 170° from the third slot 22 in the counterclockwise direction (FIG. 2).

Optionally, the outer surface of the sidewall 16C of the body 16 of the fulcrum member 14 between the first and second slots 18 and 20 is provided with a slide pad 24 (FIG. 2). The slide pad 24 is positioned so that the slide pad 24 does not fully contact the ground surface until the pry bar 12 is moved into the lifting position. In one (1) embodiment, when the pry bar 12 is lifting the object 100, only the slide pad 24 on the body 16 of the fulcrum member 14 is in contact with the ground surface. The slide pad 24 has a smooth outer surface and is constructed of a low friction material so that the fulcrum member 14 can be easily moved or slid along the ground surface while the object 100 is in the lifted position (FIG. 2). In one (1) embodiment, the slide pad 24 is constructed of nylon. In one (1) embodiment, the slide pad 24 is Teflon® coated.

The lifting tool 10 is intended to be used as a pry bar or lifting bar to lift one (1) side of an object 100 away from a surface. The tool 10 can also be used to move or slide the object 100 once the object 100 is in the lifted position. The fulcrum member 14 is mounted on the pry bar 12 such that the pry bar 12 extends between two (2) of the slots 18, 20 or 22 of the body 16 of the fulcrum member 14 and through the body 16 of the fulcrum member 14 with the first end 12A of the pry bar 12 extending beyond the fulcrum member 14 in a first direction and the second end 12B of the pry bar 12 extending outward from the fulcrum member 14 in an opposed second direction. The fulcrum member 14 is mounted on the pry bar 12 so that the pry bar 12 extends through the two (2) of the slots 18, 20 or 22 of the body 16 of the fulcrum member 14 with the longitudinal axis A-A of the pry bar 12 perpendicular to the longitudinal axis B-B of the fulcrum member 14. The fulcrum member 14 is mounted onto the pry bar 12 after the lifting end 12A of the pry bar 12 is positioned under the object 100 to be lifted. The open ended slots 18, 20 and 22 of the body 16 of the fulcrum member 14 allow the fulcrum member 14 to be easily mounted onto the pry bar 12 at any point along the length of the pry bar 12.

Once the fulcrum member 14 is mounted on the pry bar 12 and the lifting end 12A of the pry bar 12 is under the object 100 to be lifted, the user adjusts the position of the fulcrum member 14 so that the length of the pry bar 12 between the fulcrum member 14 and the handle end 12B of the pry bar 12 is such that the handle end 12B has sufficient leverage to lift the object 100. The fulcrum member 14 is movable along the length or longitudinal axis A-A of the pry bar 12 to increase or decrease the leverage provided by the handle end 12B. In one (1) embodiment, the fulcrum member 14 is positioned adjacent the first lifting end 12A of the pry bar 12 to provide the handle end 12B with maximum leverage. The leverage of the handle end 12B of the pry bar 12 can also be increased or decreased by changing the slots 18, 20 and 22 used to mount the fulcrum member 14 on the pry bar 12 which changes the angle of mounting of the fulcrum member 14 on the pry bar 12. In the one (1) embodiment where the fulcrum member 14 has a first, second and third slot 18, 20 and 22, the pry bar 12 can be mounted through the first and second slots 18 and 20 to provide a first leverage or can be mounted through the first and third slots 18 and 22 to provide a second, increased leverage.

Once the fulcrum member 14 is correctly positioned on the pry bar 12, the user exerts a downward force on the handle end 12A of the pry bar 12 so that the handle end 12A moves toward the ground surface. As the handle end 12A moves toward the ground surface, the top surface 12C of the pry bar 12 contacts the top wall of the second or third slot 20 or 22 and the bottom surface 12D of the pry bar 12 contacts the bottom wall of the first slot 18 which causes the fulcrum member 14 to rotate about the longitudinal axis B-B of the fulcrum member 14. The curved or radiused outer surface of the sidewall 16C of the body 16 of the fulcrum member 14 enables the fulcrum member 14 to easily rotate or pivot on the ground surface. The pry bar 12 pivots at the fulcrum member 14 so that the lifting end 12B of the pry bar 12 is raised away from the ground surface to lift the object 100.

To move the object 100, the object 100 is lifted into a raised position using the pry bar 12 and the fulcrum member 14. Next, a moving force is applied to the handle end 12B of the pry bar 12. The moving force is applied in the direction in which the object 100 is to be moved. The moving force moves the pry bar 12 which moves the object 100. In one (1) embodiment, when the object 100 is in the raised position, the fulcrum member 14 rotates so that the slide pad 24 of the fulcrum member 14 is the only portion of the fulcrum member 14 or the pry bar 12 which contacts the ground surface. The low friction construction of the slide pad 24 along with the smooth outer surface of the slide pad 24 allows less force to be used to move the object 100 due to the minimal friction between the fulcrum member 14 and the ground surface.

It is intended that the foregoing description be only illustrative of the present invention and that the present invention be limited only by the hereinafter appended claims.

I claim:

1. A tool for lifting an object which comprises:

(a) a pry bar having a first end towards a user and an opposed second end for prying the object defining a longitudinal axis of the pry bar with a thickness between a top surface and a bottom surface; and (b) an adjustable and removable fulcrum member having a cylindrical shape with a first end and a second end defining a longitudinal axis of the cylindrical shape of the fulcrum member and with a sidewall defining and extending a center bore around the longitudinal axis between the ends, the fulcrum member having at least two, spaced apart first and second slots extending parallel to the longitudinal axis of the fulcrum member, each slot having an open end adjacent the first end of the fulcrum member wherein a first slot is configured to be towards the user and the second slot is configured to be towards the object to be lifted, wherein the fulcrum member is configured to be slidably mounted on the pry bar between the first and second ends of the pry bar so that the pry bar extends between two of the slots through the fulcrum member and wherein the thickness of the pry bar between the top surface and the bottom surface is less than a width of the first and second slots such that the bottom surface of the pry bar engages a lower of opposed sides of the first slot and engages an upper of opposed sides of the second slot when the first end towards the user is pressed down for prying the object;

wherein the fulcrum member has a third slot towards the object to be lifted and wherein a distance around a circumference of the sidewall in a clockwise direction between the first slot and the third slot is greater than a distance around the circumference of the sidewall in the clockwise direction between the first slot and the second slot.

2. The tool of claim 1 wherein the first slot is spaced apart around a circumference of the sidewall in a clockwise direction less than 180° from the second slot.

3. The tool of claim 1 wherein a length of each of the slots between the ends is greater than a width of the pry bar between the sides.

4. The tool of claim 1 wherein the fulcrum member has three slots, one on the side of the user and two spaced apart on the side of the object to be lifted.

5. The tool of claim 1 wherein the fulcrum member is mounted on the pry bar such that the longitudinal axis of the pry bar is perpendicular to the longitudinal axis of the fulcrum member.

6. A tool for lifting an object which comprises:

(a) a pry bar having a first end towards the user and an opposed second end for prying the object defining a longitudinal axis of the pry bar with a thickness between a top surface and a bottom surface;

(b) an adjustable and removable fulcrum member having a cylindrical shape and a center bore and having a first end and a second end defining a longitudinal axis of the fulcrum member with a sidewall extending along the longitudinal axis between the ends, the fulcrum member having at least three, spaced apart first, second and third slots extending parallel to the longitudinal axis of the fulcrum member, each slot having an open end adjacent the first end of the fulcrum member wherein a first of the slots is configured to be towards the user and the second and third slots are configured to be towards the object to be lifted, wherein the fulcrum member is configured to be slidably mounted on the pry bar between the first and second ends of the pry bar so that the pry bar extends between two of the slots through the fulcrum member and wherein the thickness of the pry bar between the top surface and the bottom surface is less than a width of the first, second and third slots such that the bottom surface of the pry bar engages a lower of opposed sides of the first slot and engages an upper of the second slot when the first end towards the user is pressed down for prying the object; and (c) a slide pad mounted on an outer surface of the sidewall between two of the slots so as to slide along and then engage a ground surface during the prying.

7. A tool for lifting an object which comprises:

(a) a pry bar having a first end towards the user and an opposed second end for prying the object forming a longitudinal axis of the pry bar with a thickness between a top surface and a bottom surface; and (b) an adjustable and removable fulcrum member having a cylindrical shape and a center bore and having a first end and a second end defining a longitudinal axis of the fulcrum member with a sidewall extending along the longitudinal axis between the ends, the fulcrum member having at least three, spaced apart first, second and third slots extending parallel to the longitudinal axis of the cylindrical shape of the fulcrum member, each slot having an open end adjacent the first end of the fulcrum member wherein a first slot is configured to be towards the user and the second and third slots are configured to be towards the object to be lifted, wherein the fulcrum member is configured to be slidably mounted on the pry bar between the first and second ends of the pry bar so that the pry bar extends between two of the slots through the fulcrum member, and wherein the thickness of the pry bar between the top surface and the bottom surface is less than a width of the first and second slots such that the bottom surface of the pry bar engages a lower of opposed sides of the first slot and engages an upper of the second or third slot when the first end towards the user is pressed down for prying the object.

8. A tool for lifting an object which comprises:

(a) a pry bar having a first end towards the user and a an opposed second end for prying the object forming a longitudinal axis of the pry bar with a thickness between a top surface and a bottom surface;

(b) a fulcrum member having a cylindrical shape and a center bore and configured to be slidably and removably mounted on the pry bar between the ends of the pry bar, the fulcrum member having a first end and a second end forming a longitudinal axis of the fulcrum member with a sidewall extending between the ends and having at least two spaced apart slots extending parallel to the longitudinal axis of the fulcrum member, each of the slots having an open, first end adjacent the first end of the fulcrum member wherein a first slot is configured to be towards the user and the second and the third slots are configured to be towards the object, wherein the fulcrum member is mounted on the pry bar so that the pry bar extends between the two slots of the fulcrum member with the first end of the pry bar extending beyond one of the slots of the fulcrum member in a first direction and the second end of the pry bar extending beyond one of the other slots of the fulcrum member in a second direction opposite the first direction and wherein the thickness of the pry bar between the top surface and the bottom surface is less than a width of the first and second slots such that the bottom surface of the pry bar engages a lower of opposed sides of the first slot and engages an upper of the second slot when the first end towards the user is pressed down for prying the object; and (c) a slide pad mounted on an outer surface of the sidewall so as to slide along and then engage a ground surface during the prying.

9. The tool of claim 8 wherein the first and second directions are along the longitudinal axis of the pry bar and perpendicular to the longitudinal axis of the fulcrum member.

10. The tool of claim 8 wherein the fulcrum member has a third slot and wherein a distance around a circumference of the sidewall between the first slot and the third slot is greater than a distance around the circumference of the sidewall between the first slot and the second slot.

11. The tool of claim 10 wherein the first slot is spaced apart around the circumference of the sidewall in a clockwise direction less than 180° from the second slot.

12. The tool of claim 8 wherein a the slide pad is provided on an outer surface of the sidewall of the fulcrum member between the two of the slots and made of nylon.

* * * * *

UNITED STATES PATENT AND TRADEMARK OFFICE

CERTIFICATE OF CORRECTION

PATENT NO. : 7,618,020 B2
APPLICATION NO. : 10/996244
DATED : November 17, 2009
INVENTOR(S) : Michael L. Del Favero It is certified that error appears in the above-identified patent and that said Letters Patent is hereby corrected as shown below:

Column 2, line 45, "of the pry abr" should be --of the pry bar--.

Column 8, line 20, Claim 8, "user and a an opposed" should be --user and an opposed--.

Column 8, line 61, Claim 12, "wherein a the" should be --wherein the--.

Signed and Sealed this

Twenty-third Day of February, 2010

David J. Kappos

David J. Kappos
*Director of the United States Patent and Trademark Office*